US007254866B2

(12) United States Patent
Francoeur

(10) Patent No.: US 7,254,866 B2
(45) Date of Patent: Aug. 14, 2007

(54) VACUUM CLEANER NOZZLE

(76) Inventor: Normand Francoeur, 992 Roseline, Laval, QC (CA) H7R 4V1

( * ) Notice: Subject to any disclaimer, the term of this patent is extended or adjusted under 35 U.S.C. 154(b) by 0 days.

(21) Appl. No.: 10/430,205

(22) Filed: May 7, 2003

(65) Prior Publication Data

US 2004/0221419 A1 Nov. 11, 2004

(51) Int. Cl.
*A47L 9/06* (2006.01)

(52) U.S. Cl. ..... 15/393; 15/398; 15/401

(58) Field of Classification Search ..... 15/246.2, 15/393, 398, 400, 401, 403, 415.1, 104.001, 15/104.002, 160

See application file for complete search history.

(56) References Cited

U.S. PATENT DOCUMENTS

| | | | | | |
|---|---|---|---|---|---|
| 1,296,121 | A | * | 3/1919 | Rosenfield | 15/393 |
| 1,809,302 | A | * | 6/1931 | Lawrence | 15/246 |
| 2,893,048 | A | * | 7/1959 | Martinec | 15/422 |
| 3,087,223 | A | * | 4/1963 | Raw | 26/27 |
| 3,745,605 | A | * | 7/1973 | Gitschel et al. | 15/400 |
| 3,761,990 | A | * | 10/1973 | Lynn | 15/160 |
| 3,820,189 | A | * | 6/1974 | Roth | 15/400 |
| 4,319,379 | A | * | 3/1982 | Carrigan et al. | 15/400 |
| 5,187,834 | A | * | 2/1993 | Stark | 15/398 |
| 2002/0066154 | A1 | | 6/2002 | Kaffenberger et al. | |

FOREIGN PATENT DOCUMENTS

| | | | |
|---|---|---|---|
| CA | 1179458 | | 12/1984 |
| JP | 4-89019 | * | 3/1993 |

* cited by examiner

*Primary Examiner*—Terrence R. Till

(57) ABSTRACT

A cleaning implement for cleaning a soiled surface having soiling particles lodge therein includes a body having a cleaning surface defining first and second cleaning section. The first and second cleaning sections are provided respectively with first and second dislodging bristles for dislodging the soiled particles from the soiled surface. The first and second cleaning bristles are configured and positioned so that the dislodging action is performed more efficiently when the first and second cleaning section are move relative to the soiled surface respectively in a first and a second direction as opposed to other directions. The implement is connectable to a vacuum source for suctioning the soiling particles having been dislodged by the first and second cleaning surfaces.

9 Claims, 3 Drawing Sheets

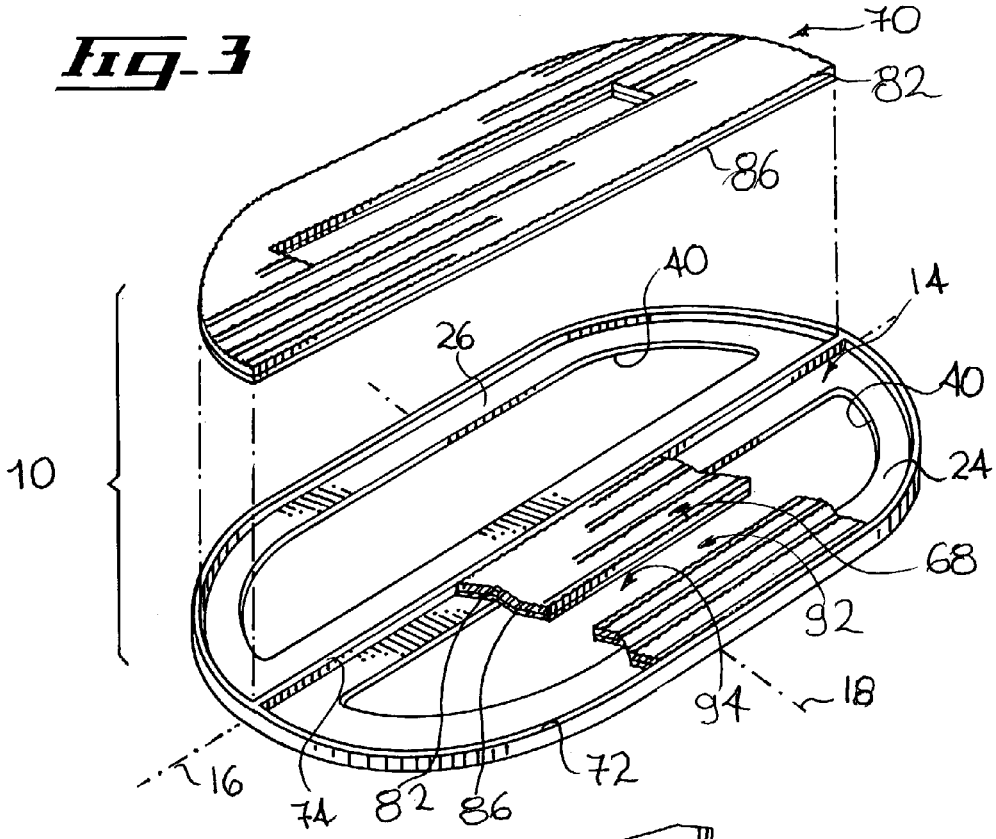
Fig. 3
70
82
86
40
14
26
40
10
24
68
92
94
18
16
74
82
86
72
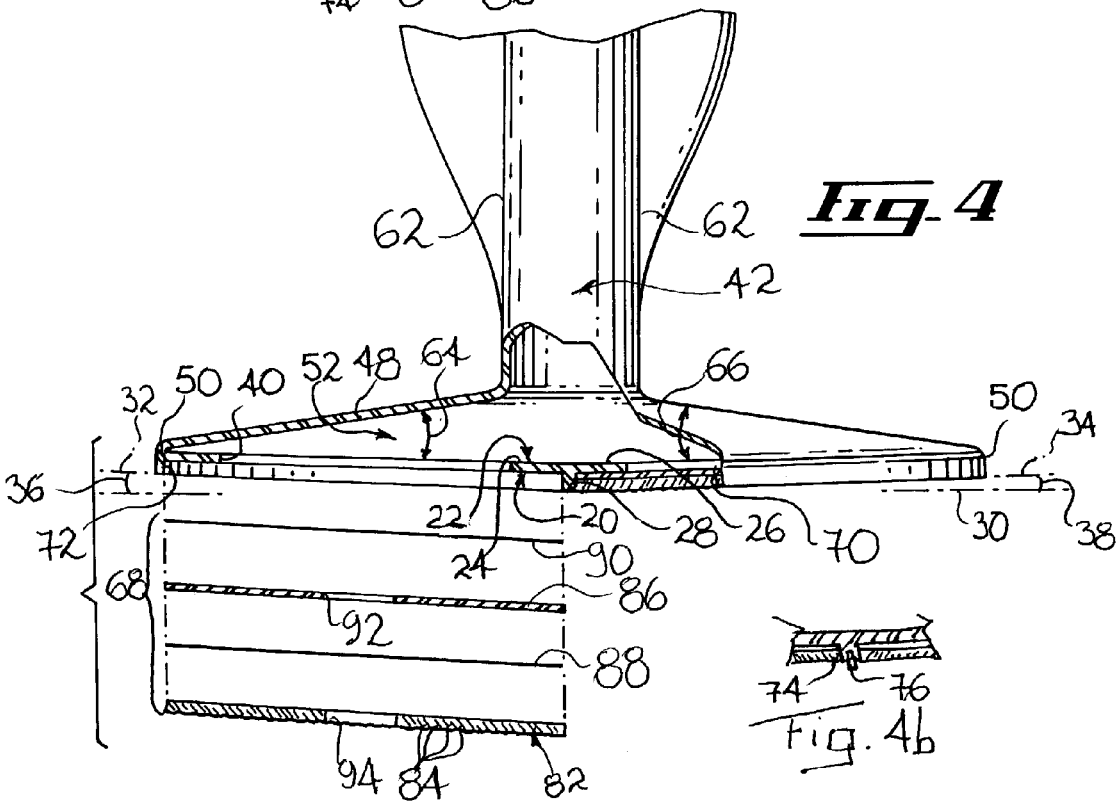
Fig. 4
62
62
42
32
50
40
52
48
64
66
50
34
36
72
22
20
28
26
70
30
38
24
90
68
86
92
88
94
84
82
74
76
Fig. 4b 12
42
48
62
26
56
70
80
68
24
98
78
52
74
72
100
82
86
14

VACUUM CLEANER NOZZLE

FIELD OF THE INVENTION

The present invention relates to the general field of cleaning implements and is particularly concerned with a vacuum cleaner nozzle.

BACKGROUND OF THE INVENTION

Vacuum cleaners are used extensively to collect alien substances such as dust, dirt and other soiling particles from soiled surfaces by means of a negative pressure created by a vacuum pump located within a main body. A flexible hose is typically pneumatically coupled to the vacuum pump. Various cleaning implements including various types of nozzles may be attached directly to the flexible hose or to a suction pipe itself attached to the distal end of the flexible hose. Nozzles of various configurations are typically provided for use in particular situations.

Most of these prior art vacuum cleaner nozzles have proven to be somewhat satisfactory when cleaning rugs having relatively short pile. However, such prior part vacuum cleaner nozzles have proven to be somewhat unsatisfactory for cleaning deep pile carpets, shag rugs and other surfaces having relatively long or loose strands.

Indeed, most prior art vacuum cleaner nozzles are not well adapted to remove the dirt and dust particles that are present between and below the fibers of the pile. When conventional vacuum cleaner nozzles are used over surfaces having relatively long strands, the latter are merely levelled by the nozzles during the cleaning operation. Such levelling tends to cover the dirt or other particles at the base of the strands thereby preventing the particles from being picked up by the vacuum.

Typically, it is only at the end of a cleaner stroke that the strands are picked up by the nozzle since stroke reversal mechanically pulls the strands to an upright position. This results in an unsightly situation since areas of the rug are flattened with tufts of upright strands at either end of those areas.

In order to circumvent these problems, rug manufacturers have suggested that the rugs be raked prior to cleaning in order to separate the strands so that the cleaner may pick up dirt between those strands. After vacuuming, the rug must be raked again to fluff the strands and to eliminate the matted strand areas. These operations are tedious and time consuming. Furthermore, they require the use of several implements. Accordingly, there exists a need for an improved vacuum cleaner nozzle.

SUMMARY OF THE INVENTION

It is a general object of the present invention to provide an improved vacuum cleaner nozzle.

In accordance with the present invention, there is provided a cleaning implement for cleaning a soiled surface having soiling particles lodge therein, said cleaning implement comprising: a body defining a cleaning surface, the cleaning surface having a first cleaning section and a substantially adjacent second cleaning section; the first cleaning section being provided with first dislodging means for dislodging the soiled particles from the soiled surface, the first dislodging means being such that the dislodging action is performed more efficiently when the first cleaning section is move relative to the soiled surface in a first direction as opposed to other directions; the second cleaning section being provided with second dislodging means for dislodging the soiled particles from the soiled surface, the second dislodging means being such that the dislodging action is performed more efficiently when the second cleaning section is move relative to the soiled surface in a second direction as opposed to other directions.

Typically, the first and second dislodging means are such that the first and second directions extend at substantially 180 degrees relative to each other. Typically, the first and second dislodging means are such that the first direction leads towards the second cleaning section and the second direction leads towards the first cleaning section. Typically, the cleaning surface defines a cleaning surface peripheral edge; the first and second cleaning sections extend respectively from substantially opposite segments of the surface peripheral edge towards each other to a common transition area.

Conveniently, the first and second cleaning sections are angled relative to each other about the common transition area in a direction leading away from each other so that the cleaning surface has a substantially convex configuration.

Preferably, the vacuum cleaner nozzle further comprises a vacuum means operatively coupled to the cleaning surface for providing a vacuum force therethrough.

Typically, the first and second dislodging means include friction increasing means for increasing the frictional force between the first and second cleaning sections and the soiled surface when the first and second cleaning sections are rubbed across the soiled surface respectively in the first and second direction as opposed to other directions.

Preferably, the first and second sections are provided with a surface material having fibers oriented respectively substantially towards the first and second directions.

Optionally, the vacuum cleaner nozzle further comprises a protruding rib located substantially intermediate the first and second sections, the protruding rib extending at least partially across the cleaning surface and protruding outwardly therefrom. Typically, the protruding rib is made out of an elastomeric material.

In accordance with the present invention, there is also provided a vacuum cleaner nozzle for cleaning a soiled surface having soiling particles lodge therein, the vacuum cleaner nozzle being usable with a vacuum cleaner having a vacuum hose pneumatically attachable thereto, the vacuum cleaner nozzle comprising: a base wall, the base wall defining a base wall longitudinal axis and a generally perpendicular base wall transversal axis, the base wall also defining a base wall first surface and an opposed base wall second surface, the base wall further defining a base wall first section and a base wall second section, the base wall first and second sections being angled relative to each other about a base wall apex so as to define a substantially flattened "V"-shaped transversal cross-sectional configuration with the base wall first surface being generally convex and the base wall second surface being generally concave; at least one of the base wall first or second sections having a base wall suction aperture extending therethrough; a coupling adaptor extending from the base wall for pneumatically coupling the base wall suction aperture to the vacuum hose.

Typically, the base wall defines a base wall peripheral edge, the coupling adaptor including a coupling tube, the coupling tube defining a tube first end and a tube second end, the tube first end being pneumatically attachable to the vacuum hose; a coupling wall extending between the tube second end and the base wall substantially adjacent the base wall peripheral edge; the coupling wall being spaced from the base wall second surface so as to define a coupling chamber therebetween, the coupling chamber being in pneumatic communication with both the coupling tube and the base wall suction apertures.

Conveniently, the first cleaning pad is provided with first dislodging means for dislodging the soiled particles from the soiled surface, the first dislodging means being such that the dislodging action is performed more efficiently when the first cleaning pad is moved relative to the soiled surface in a first direction as opposed to other directions; the second cleaning pad is provided with second dislodging means for dislodging the soiled particles from the soiled surface, the second dislodging means being such that the dislodging action is performed more efficiently when the second cleaning pad is move relative to the soiled surface in a second direction as opposed to other directions.

Typically, the first and second dislodging means include friction increasing means for increasing the frictional force between the first and second cleaning pads and the soiled surface when the first and second cleaning pads are rubbed across the soiled surface respectively in the first and second directions as opposed to other directions. Also, typically, the first and second pads are provided with a surface material having fibers oriented respectively substantially towards the first and second directions.

Conveniently, the base wall also includes a separation lip extending at least partially thereacross substantially along the base wall longitudinal axis, the separation lip dividing the pad receiving cavity into a cavity first section and a cavity second section for respectively receiving the first and second pads. Optionally, the separation lip is provided with a scraping component extending substantially outwardly therefrom, the scraping component protruding outwardly relative to the surface material.

Advantages of the present invention include that the proposed vacuum cleaner nozzle is specifically designed so as to provide a directional raking action such that the raking of strands extending from a soiled surface occurs mainly when the nozzle is moved across the surface to be cleaned in a predetermined direction. The vacuum cleaning nozzle may hence be used, as needed, with or without a raking action depending on the relative movement between the vacuum cleaner nozzle and the surface being cleaned.

The proposed vacuum cleaner nozzle selectively provides a raking action through a set of quick and ergonomical steps. Also, the vacuum cleaner nozzle allows for cleaning of a soiled surface not only with or without a raking action but also in a variety of positions. The proposed invention allows for efficient cleaning of a variety of surfaces such as rugs, carpets, furniture, car upholstery, pets and the like with reduced risks of damaging the latter.

The proposed vacuum cleaner nozzle selectively allows for both raking and vacuuming simultaneously. The configuration of the vacuum cleaner nozzle in accordance with the present invention is such that a synergic effect occurs between the suctioning and raking actions, hence producing an overall efficient cleaning action.

The proposed vacuum cleaner nozzle is designed so as to be usable and/or retrofittable with various types of vacuum cleaners including canister, light weight, upright, stick type and other types of conventional vacuum cleaners without requiring undue modifications of the latter. Also, the proposed vacuum cleaner nozzle may be used without attachment to a conventional vacuum cleaner and, hence, may be used as a cleaning implement per se.

Still furthermore, the proposed vacuum cleaner nozzle is designed so as to be manufacturable using conventional forms of manufacturing so as to provide a vacuum cleaner nozzle that would be economically feasible, long-lasting and relatively trouble-free in operation.

BRIEF DESCRIPTION OF THE DRAWINGS

An embodiment of the present invention will now be disclosed, by way of example, in reference to the drawings in which:

FIG. 3, in a partially exploded view with sections taken out, illustrates the bottom section of the vacuum cleaner nozzle shown in FIGS. 1 and 2 with one of its cleaning pads partially removed and the other cleaning pad about to be mounted thereto;

FIG. 4, in a front elevational view with a partial transversal cross-section taken out, illustrates some of the features of the vacuum cleaner nozzle shown in FIGS. 1 through 3;

FIG. 4*b* in a partial transversal cross-sectional view with sections taken out, illustrates part of the vacuum cleaner nozzle in accordance with an alternative embodiment of the invention having a scraping component attached thereto;

DETAILED DESCRIPTION

Figure 1:
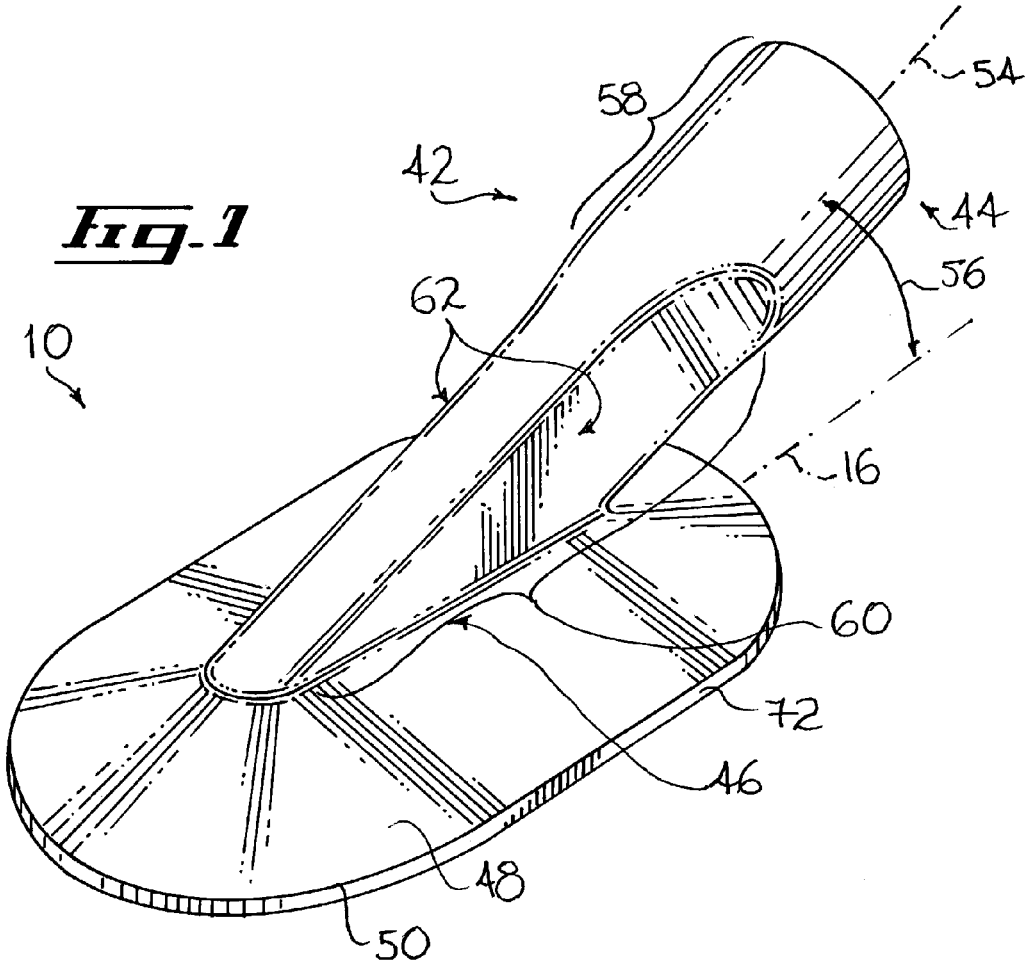
FIG. 1, in a top perspective view, illustrates a vacuum cleaner nozzle in accordance with an embodiment of the present invention.
Figure 2:
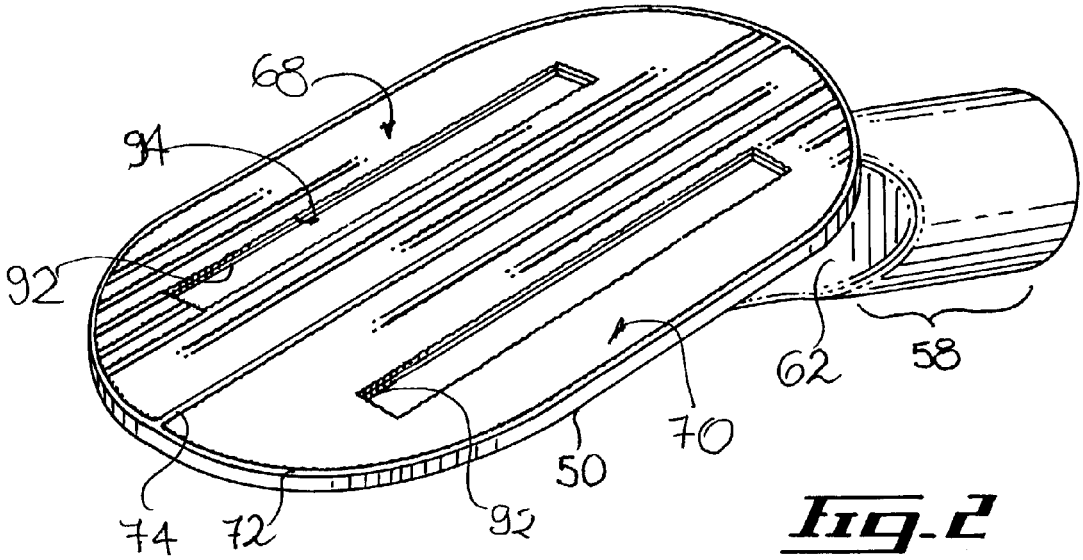
FIG. 2, in a bottom perspective view, illustrates a vacuum cleaner nozzle in accordance with an embodiment of the present invention.

Referring to FIG. 1, there is a shown a vacuum cleaner nozzle 10 in accordance with an embodiment of the present invention. The vacuum cleaner nozzle 10 is intended to be used typically for cleaning a soiled surface such as the surface 12, schematically illustrated in FIGS. 5 and 6 having soiling particles lodged therein. It should be understood that although the soiled surface is shown schematically in FIGS. 5 and 6 as being generally planar, the vacuum cleaner nozzle 10 could be used on any suitable type of relatively soiled surface without departing from the scope of the present invention.

Also, although the vacuum cleaner nozzle 10 is disclosed throughout the specification as being used for removing soiling particles lodged within a soiled surface. It should however be understood that the vacuum cleaner nozzle 10 could be used for other types of cleaning operations including the removal of any type of particles lodged or not within a soiled surface without departing from the scope of the present invention.

Typically, the vacuum cleaner nozzle 10 is usable with a conventional vacuum cleaner having a vacuum hose (not shown) attached thereto. It should, however, be understood that the vacuum cleaner nozzle 10 could be used with other types of cleaning implements and could also be pneumatically fitted or made an integral part of any suitable type of cleaning implement without departing from the scope of the present invention.

As illustrated in FIG. 3, the vacuum cleaner nozzle 10 includes a base wall 14. The base wall 14 defines a base wall longitudinal axis 16 and a generally perpendicular base wall transversal axis 18. The base wall 14 also defines a base wall first surface 20 and an opposed base wall second surface 22. The base wall 14 further defines a base wall first section 24 and a base wall second section 26.

As illustrated more specifically in FIG. 4, the base wall first and second sections 24, 26 are angled relative to each other about a base wall apex 28 so as to define a substantially flattened V-shaped transversal cross-sectional configuration. The base wall first surface 20 is hence generally convex while the base wall second surface 22 is hence generally concave.

When the base wall apex 28 is positioned in a reference geometrical plane 30, the base wall first and sections 24, 26 extend respectively in corresponding base wall first and second geometrical planes 32, 34. The base wall first and second geometrical planes 32, 34 define corresponding first and second surface-to-reference angles 36, 38. In the embodiments shown throughout the figures, the surface-to-reference angles 36, 38 are substantially equal relative to each other. Typically, although by no means exclusively, the first and second base wall-to-reference angles 36, 38 have a value substantially in the range of 1 to 15 degrees.

It should however be understood that although the first and second surface-to-reference angles 36, 38 are shown as being substantially similar so as to define a generally symmetrical relationship between the base wall first and second sections 24, 26 the base wall-to-reference angles 36, 38 could be different relative to each other without departing from the scope of the present invention.

As illustrated more specifically in FIG. 3, at least one of the base wall first or second sections 24, 26 and typically both of the base wall first or second sections 24, 26 are provided with a base wall suction aperture 40 extending therethrough. In the embodiments shown throughout the figures, the base wall suction apertures 40 have a substantially D-shaped configuration and are substantially symmetrically disposed relative to each other about the base wall longitudinal axis 16. It should, however, be understood that the base wall suction apertures 40 could have other configurations and locations without departing from the scope of the present invention.

Also, as shown throughout the figures, the base wall suction apertures 40 typically extend through a substantial portion of the base wall first and second sections 24, 26 so as to leave only a marginal peripheral section. It should, however, be understood that the base wall suction apertures 40 could have a different size proportionality relative to the size of the base wall first and second sections 24, 26 without departing from the scope of the present invention.

The vacuum cleaner nozzle 10 also includes a coupling adapter 42 extending from the base wall 14 for pneumatically coupling the base wall suction apertures 40 to a suitable vacuum source such as the vacuum hose of the vacuum cleaner (not shown). As illustrated more specifically in FIG. 1, the coupling adapter 42 typically includes a coupling tube defining a tube first end 44 and an opposed tube second 46. The tube first end 44 is typically designed so as to be pneumatically attachable to the vacuum hose (now shown).

The coupling adaptor 42 also typically includes a coupling wall 48 extending between the tube second end 46 and the base wall 14 substantially adjacent the base wall peripheral edge 50. As illustrated more specifically in FIG. 4, the coupling wall 48 is typically spaced from the base wall second surface 22 so as to define a coupling chamber 52 therebetween. The coupling chamber 52 is hence in pneumatic communication with both the coupling tube 42 and the base wall suction apertures 40.

The coupling tube 42 defines a tube longitudinal axis 54. The tube longitudinal axis 54 is typically angled relative to the base wall 14 by a tube-to-base wall angle 56. Typically, the base wall apex 28 extends in a substantially co-linear relationship relative to the base wall longitudinal axis 16. Also, typically, the tube and base wall longitudinal axes 54, 15 are in a substantially co-planar relationship relative to each other. Typically, although by no means exclusively, the tube-to-base wall angle 56 has a value substantially in the range of between 10 and 90 degrees.

Typically, the coupling tube 42 defines a tube first section 58 located substantially adjacent the tube first end 44 and a tube second section 60 extending from the tube second end 46 to the tube first section 58. Typically, the tube first section 58 has a substantially cylindrical configuration that tapers inwardly upon reaching the tube second section 60 about the pair of opposed tube circumferential flat sections 62. The tube second section 60 hence typically has a substantially flattened ovaloid cross-sectional configuration.

As illustrated more specifically in FIG. 4, the coupling wall 48 is typically angled relative to the base wall first and second sections 24, 26 by corresponding first and second coupling-to-base wall angles 64, 66. Typically, although by no means exclusively, the coupling chamber 52 has a substantially flattened parallelogram-shaped transversal cross-sectional configuration.

As illustrated more specifically in FIGS. 3 and 4, the vacuum cleaner nozzle 10 typically further includes a first cleaning pad 68 and a second cleaning pad 70 both mounted on the base wall first surface 20 substantially over respectively the first and second base wall sections 24, 26. Optionally, either one or both the first or second cleaning pads 68, 70 are releasably mounted on the base wall first surface 20 so as to facilitate replacement thereof.

Typically, the base wall 14 includes a peripheral lip 72 extending substantially outwardly therefrom substantially adjacent the base wall peripheral edge 50. The peripheral lip and the base wall 14 together define a pad receiving cavity for receiving the first and second pads 68, 70. In the embodiments shown throughout the figures, the pad receiving cavity has a substantially ovaloid configuration. It should, however, be understood that the pad receiving cavity could have other configurations without departing from the scope of the present invention.

Typically, the base wall 14 also includes a separation lip 74 extending at least partially thereacross substantially along the base wall longitudinal axis 16. In the embodiment shown throughout the figures, the separation lip 74 extends across the base wall 14. As shown more specifically in FIG. 3, the separation lip 74 provides the pad receiving cavity into a cavity first section and a cavity second section for respectively receiving the first and second pads 68, 70.

As illustrated in FIG. 4*a*, the cleaning implement 10 may optionally be further provided with a scraping component 76 extending substantially outwardly from the separation lip 74. The scraping component 76 is configured and sizes so as to protrude outwardly relative to the first and second pads 68, 70. Typically, when a scraping component 76 is included, the separation lip 74 is provided with a separation lip channel formed therein. Also, typically, the scraping component 76 includes a scraping blade at least partially mounted within the separation lip channel for attachment thereto. Typically, although by no means exclusively, the scraping blade is made of an elastomeric material.

The first cleaning pad 68 is preferably provided with first dislodging means for dislodging the soiled particles from the soiled surface. The first dislodging means is designed such that the dislodging action is performed more efficiently when the first cleaning section 24 is moved relative to the soiled surface 12 in a first direction as opposed to other directions.

Similarly, the second cleaning pad 70 is preferably provided with second dislodging means for dislodging the soiled particles from the soiled surface. The second dislodging means is designed such that the dislodging action is performed more efficiently when the second cleaning section 26 is moved relative to the soiled surface 12 in a second direction as opposed to other directions.

Figures 5, 6, 7:
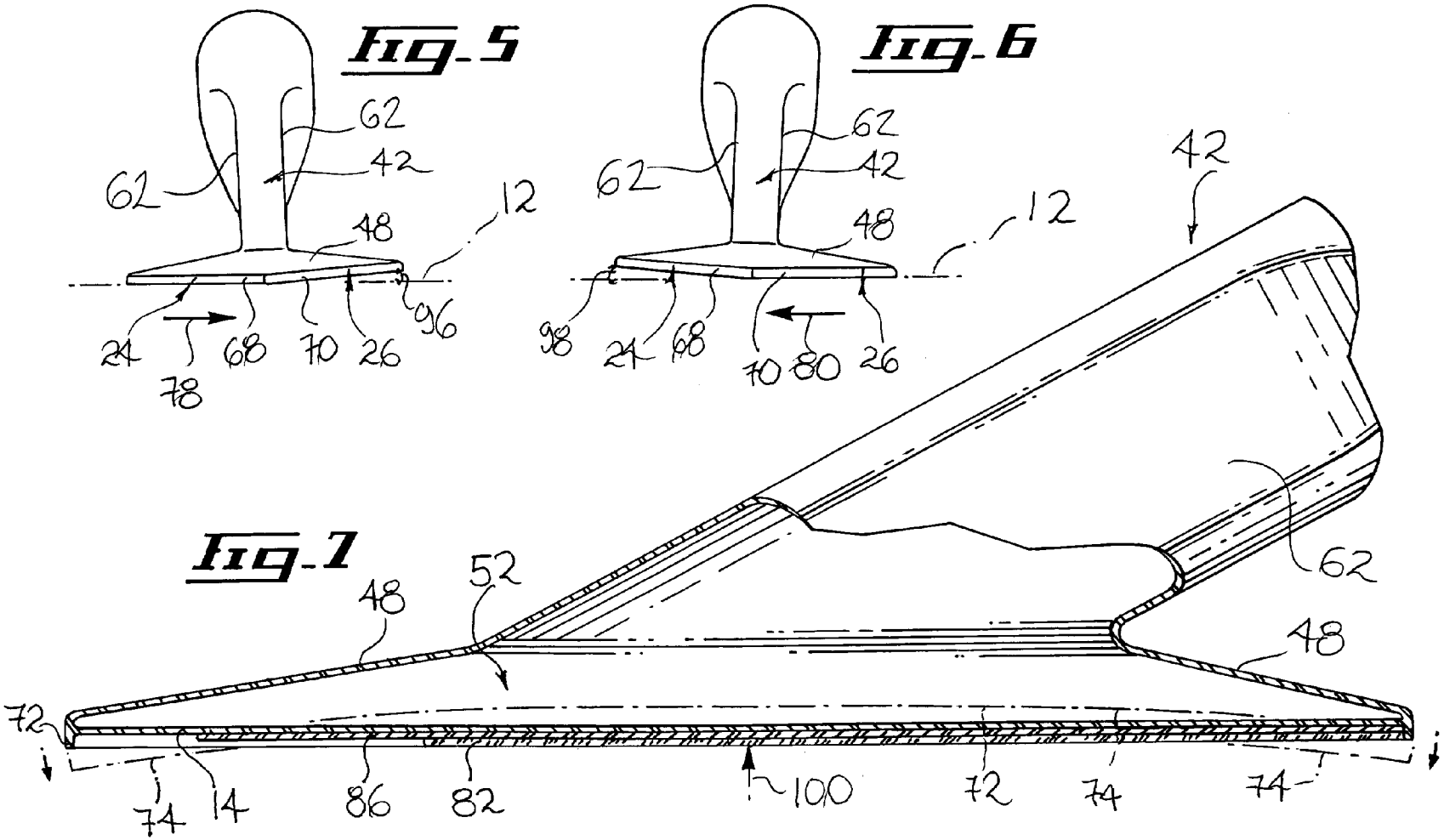
FIG. 5, in a schematic front elevational view, illustrates the vacuum cleaner nozzle shown in FIGS. 1 through 4 in a first cleaning configuration being moved in a first direction.
FIG. 6, in a front schematic elevational view (or as worded in FIG. 5 ?), illustrates the vacuum cleaner nozzle shown in FIGS. 1 through 5 in a second cleaning configuration being moved in a second direction.
FIG. 7, in a side elevational view with a partial longitudinal section taken out, illustrates some of the features of the vacuum cleaner nozzle shown in FIGS. 1 through 6.

Typically, the first and second dislodging means are such that the first and second directions extend at substantially 180 degrees relative to each other. Typically, as illustrated in FIGS. 5 and 6, the first and second dislodging means are such that the first direction 78 leads towards the second cleaning pad 26 and the second direction 80 leads towards the first cleaning pad 24. The first and second dislodging means typically include friction increasing means for increasing the frictional force between the first and second cleaning pads 68, 70 and the soiled surface 12 when the first and second cleaning pads 68, 70 are rubbed across the soiled surface 12 respectively in the first and second directions 78, 80 as opposed to other directions.

As illustrated more specifically in FIGS. 3 and 4, the first and second pads 68, 70 are typically provided with a surface material 82 having fibres or bristles 84 oriented respectively substantially towards the first and second directions 78, 80. Typically, although by no means exclusively, the surface material is of the type similar to the products sold under the trade mark "DE-LINT". This type of product offers directional dislodging features whereby the dislodging capacity of the product can be greatly increased when the product is rubbed against a soiled surface in a predetermined direction. Typically, although by no means exclusively, the surface material 82 may also be selected from a material group including felt, nylon, cotton, polyester or rayon. The orientation of the fibres or bristles 84 and/or the type of material used is adapted to act as the friction increasing means for increasing the frictional force between the first and second cleaning pads 68, 70 and the soiled surface 12 when the first and second cleaning pads 68, 70 are rubbed across the soiled surface 12 respectively in the first and second directions 78, 80 as opposed to other directions.

Furthermore, the fibres 84 of the surface material 82 are typically oriented at an angle relative to the base wall 14 so that their distal tip provides a raking action for dislodging the soiled particles from the soiled surface 12 when the vacuum cleaner nozzle 10 is moved in a corresponding one of the first or second directions 78, 80. When the vacuum cleaner nozzle 10 is moved in directions other than the corresponding first or second directions 78, 80, the fibres 84 will have the tendency to bend, hence reducing their friction co-efficient relative to the soiled surface 12.

Typically, both the first and second pads 68, 70 include a pad base 86 for attachment to the base wall first surface 20 and the surface material 82 is typically secured to the pad base 86. In the embodiment shown in FIG. 4, the pad base 86 includes a strip of suitable material such as a suitable polymeric resin.

The surface material 82 is secured to a first surface of the pad base 86 using a suitable surface material-to-pad base attachment means. The surface material-to-pad base attachment means may take any suitable form such as a first layer 88 of suitable adhesive material. Similarly, the pad base 86 is typically secured to the base wall first surface 20 using any suitable pad base-to-base wall attachment means such as a second layer 90 of suitable adhesive material, a clip-type attachment or the like.

The pad base 86 and the surface material 82 are typically provided respectively with a pad base aperture 92 and a surface material aperture 94 extending respectively therethrough. The pad base aperture 82 and the surface material aperture 94 are positioned so as to be in pneumatic communication with the base wall apertures 40 as the pad base and surface material apertures 92, 94 each define pad suction apertures extending preferably through both the first and second cleaning pads 68, 70 and these pads suctions apertures are preferably configured, sized and positioned so as to be substantially in register with the corresponding base wall suctions aperture 40.

In use, the vacuum cleaner nozzle 10 is preferably attached to a suitable vacuum source such as a conventional vacuum cleaner. Alternatively, the vacuum cleaning nozzle 10 could be used as a cleaning implement on its own without connection to a vacuum cleaner nozzle source. When coupled to a vacuum cleaning, the distal end of the tube of the vacuum cleaner is typically inserted within at least a portion of the tube first section 58 part of the coupling tube 42. Releasable locking means such as conventional tongue and groove arrangements or other suitable may be used for releasably securing the distal end of the vacuum cleaner tube to the vacuum cleaner nozzle 10.

As shown in FIGS. 5 and 6, the vacuum cleaning nozzle 10 is intended to be used with the surface material of the first and second cleaning pads 58, 70 alternatively contacting the soiled surface 12. When the first cleaning pad 68 contacts the soiled surface 12, the angle between the base wall first and second sections 24, 26 is such that the second cleaning pad 70 is spaced from the soiled surface 12 by second pad-to-surface spacing 96.

Similarly, when the second cleaning pad 70 contacts the soiled surface 12, the angle between the first and second base wall sections 24, 26 is such that the first cleaning pad 68 is spaced from the soiled surface 12 by a first pad-to-surface spacing 98. The first and second cleaning pads 68, 70 may be easily put selectively and alternatively in contact with the soiled surface 12 by merely pivoting the vacuum cleaner nozzle 10 about the apex 28 using the separating lip 74 as a pivotal abutment means.

When the vacuum cleaner nozzle 10 is rubbed across the soiled surface 12 in a first direction 78 extending substantially in a parallel relationship relative to the base wall transversal axis 18 with the first cleaning pad 68 contacting the soiled surface 12, the orientation of the fibres 84 is such that the latter may act as a raking means for dislodging soiling particles from the soiled surface 12. The dislodged soiling particles are then either picked up at a later stage or suctioned through the cleaning pad apertures and base wall aperture 40 through the coupling tube 42 into the vacuum source.

Similarly, when the second cleaning pad 70 contacts the soiled surface 12 and the vacuum cleaner nozzle 10 is moved in the second direction substantially parallel to the base wall transversal axis 18, the angle of the fibres 84 of the second cleaning pad 70 is such that the fibres 84 act as a raking means for dislodging the soiling particles from the soiled surface 12. When a scraping blade 76 is present, the scraping blade 76 further acts as a scraper or raking means for dislodging soiling particles from the soiled surface 12. Hence, although the vacuum cleaner nozzle 10 may be efficiently in many settings, the vacuum cleaner nozzle 10 is particularly well designed for use in situations wherein soiling particles must be dislodged from a soiled surface such as rugs, carpets, pets or the like are to be suctioned into a vacuum cleaner. The bristles or fibres 82 being made out of a suitable polymeric resin, the friction thereof with the soiled surface generates static electricity which, combined with the angle of the bristles facilitates dislodging of the soiled particles from the soiled surface and temporary capture of the soiling particles prior to the latter being released and sucked into the vacuum means.

As shown more specifically in FIG. 7, the various components making up the vacuum cleaner nozzle 10 are preferably configured and sized so as to allow sections of the vacuum cleaner nozzle 10 to bend in a direction parallel to the base wall longitudinal axis 16 so as to maintain a suction seal about the peripheral edge of the components contacting the soiled surface 12. Hence, upon application of a contacting force 100 by the soiled surface 12 on the peripheral end separating lips 72, 74, the latter will bend resiliently according to the configuration shown in phantom lines and resiliently spring back to the configuration shown in full lines upon withdrawal of the contacting force 100.

I claim:

1. A cleaning implement for cleaning a soiled surface having soiling particles lodge therein, said cleaning implement comprising:

a body defining a cleaning surface, said cleaning surface having a first cleaning section and a substantially adjacent second cleaning section;

said first cleaning section being provided with first dislodging means for dislodging said soiled particles from said soiled surface, said first dislodging means being such that the dislodging action is performed more efficiently when said first cleaning section is move relative to said soiled surface in a first direction as opposed to other directions;

said second cleaning section being provided with second dislodging means for dislodging said soiled particles from said soiled surface, said second dislodging means being such that the dislodging action is performed more efficiently when said second cleaning section is move relative to said soiled surface in a second direction as opposed to other directions;

said first and second dislodging means including friction increasing means for increasing the frictional force between said first and second cleaning sections and said soiled surface when said first and second cleaning sections are rubbed across said soiled surface respectively in said first and second direction as opposed to other direction; said friction increasing means including said first and second sections being provided with a surface material having fibers oriented respectively substantial towards said first and second directions;

said cleaning implement further comprising a protruding rib located substantially intermediate said first and second sections, said protruding rib extending at least partially across said cleaning surface and protruding outwardly therefrom.

2. A cleaning implement as recited in claim 1 wherein said protruding rib is made out of an elastomeric material.

3. A vacuum cleaner nozzle for cleaning a soiled surface having soiling particles lodge therein, said vacuum cleaner nozzle being usable with a vacuum cleaner having a vacuum hose pneumatically attachable thereto, said vacuum cleaner nozzle comprising:

a base wall, said base wall defining a base wall longitudinal axis and a generally perpendicular base wall transversal axis, said base wall also defining a base wall first surface and an opposed base wall second surface, said base wall further defining a base wall first section and a base wall second section, said base wall first and second sections being angled relative to each other about a base wall apex so as to define a substantially flattened "V"-shaped transversal cross-sectional configuration with said base wall first surface being generally convex and said base wall second surface being generally concave; at least one of said base wall first or second sections having a base wall suction aperture extending therethrough;

a coupling adaptor extending from said base wall for pneumatically coupling said base wall suction aperture to said vacuum hose;

both said base wall first and second sections being provided with a corresponding base wall suction aperture extending therethrough said base wall defining a base wall peripheral edge, said coupling adaptor including a coupling tube, said coupling tube defining a tube first end and a tube second end, said tube first end being pneumatically attachable to said vacuum hose;

a coupling wall extending between said tube second end and said base wall substantially adjacent said base wall end peripheral edge;

said coupling wall being spaced from said base wall second surface so as to define a coupling chamber therebetween, said coupling chamber being in pneumatic communication with both said coupling tube and said base wall suction apertures;

said coupling tube defining a tube first section located substantially adjacent said tube first end and a tube second section extending from said tube second end to said tube first section; said tube first section having a substantially cylindrical configuration tapering inwardly upon reaching said tube second section about a pair of opposed tube circumferential flat sections so as to define a tube second section having a substantially flattened ovaloid cross-sectional configuration.

4. A vacuum cleaner nozzle for cleaning a soiled surface having soiling particles lodge therein, said vacuum cleaner nozzle being usable with a vacuum cleaner having a vacuum hose pneumatically attachable thereto, said vacuum cleaner nozzle comprising:

a base wall, said base wall defining a base wall longitudinal axis and a generally perpendicular base wall transversal axis, said base wall also defining a base wall first surface and an opposed base wall second surface, said base wall further defining a base wall first section and a base wall second section, said base wall first and second sections being angled relative to each other about a base wall apex so as to define a substantially flattened "V"-shaped transversal cross-sectional configuration with said base wall first surface being generally convex and said base wall second surface being generally concave; at least one of said base wall first or second sections having a base wall suction aperture extending therethrough;

a coupling adaptor extending from said base wall for pneumatically coupling said base wall suction aperture to said vacuum hose;

said vacuum cleaner nozzle further comprising a first cleaning pad and a second cleaning pad both mounted on said base wall first surface substantially over respectively said first and second base wall sections;

said first cleaning pad being provided with first dislodging means for dislodging said soiled articles from said soiled surface, said first dislodging means being such that the dislodging action is performed more efficiently when said first cleaning pad is moved relative to said soiled surface in a first direction as opposed to other directions;

said second cleaning pad being provided with second dislodging means for dislodging said soiled particles from said soiled surface, said second dislodging means being such that the dislodging action is performed more efficiently when said second cleaning pad is move relative to said soiled surface in a second direction as opposed to other directions;

said base wall including a peripheral lip extending substantially outwardly therefrom substantially adjacent said base wall peripheral edge; said peripheral lip and said base wall together defining a pad receiving cavity for receiving said first and second pads.

5. A cleaning implement as recited in claim 4 wherein said pad receiving cavity has a substantially ovaloid configuration.

6. A cleaning implement as recited in claim 4 wherein said base wall also includes a separation lip extending at least partially thereacross substantially along said base wall longitudinal axis, said separation lip dividing said pad receiving cavity into a cavity first section and a cavity second section for respectively receiving said first and second pads.

7. A cleaning implement as recited in claim 6 wherein said separation lip is provided with a scraping component extending substantially outwardly therefrom, said scraping component protruding outwardly relative to said surface material.

8. A cleaning implement as recited in claim 7 wherein said separation lip is provided with a separation lip channel formed therein and wherein said scraping component includes a scraping blade at least partially mounted within said separation lip channel.

9. A cleaning implement as recited in claim 8 wherein said scraping blade is made out of an elastomeric material.

* * * * *